United States Patent [19]

Stocker

[11] 4,078,790

[45] Mar. 14, 1978

[54] SHEET COLLECTOR

[75] Inventor: Lester H. Stocker, Phillipsburg, N.J.

[73] Assignee: Bell & Howell Company, Phillipsburg, N.J.

[21] Appl. No.: 759,218

[22] Filed: Jan. 13, 1977

[51] Int. Cl.[2] ..... B65H 31/28

[52] U.S. Cl. ..... 271/213; 198/422; 271/246

[58] Field of Search ..... 271/213, 246, 245, 247, 271/216, 221, 222; 198/491, 422; 93/93 DP, 93 R; 214/6 D

[56] References Cited

U.S. PATENT DOCUMENTS

| | | | |
|---|---|---|---|
| 1,115,675 | 11/1914 | Jacoby | 271/246 |
| 3,724,640 | 4/1973 | Rapparlie | 271/213 X |
| 3,861,516 | 1/1975 | Indse et al. | 271/213 |

*Primary Examiner*—Bruce H. Stoner, Jr.
*Attorney, Agent, or Firm*—Griffin, Branigan and Butler

[57] ABSTRACT

A sheet collector for serially receiving a plurality of sheets, retaining the sheets in a stack, and selectively ejecting the entire stack of sheets from the sheet collector includes a driven endless conveyor, idler rollers positioned adjacent to the driven endless conveyor, and movable stops positioned downstream of the idler rollers. An idler-roller/stop shaft, positioned adjacent to, but below the path of the sheets, is rigidly attached to the stops and an axle support for the idler rollers. The idler-roller/stop shaft is rotated angularly to move the stops and the idler rollers from opposite sides of the sheet path, into the sheet path. When the stops are rotated into the path of the sheets, the sheets contact the stops and are held from further movement. However, when the idler rollers are moved into the sheets' path they contact the stack of sheets previously held by the stops and urge the sheets against the driven endless conveyor which ejects the stack or pile of sheets from the sheet collector. The angular positions of the stops and the idler rollers on the idler-roller/stop shaft are adjustable and the amount of angular rotation of the idler-roller/stop shaft is also adjustable.

9 Claims, 6 Drawing Figures

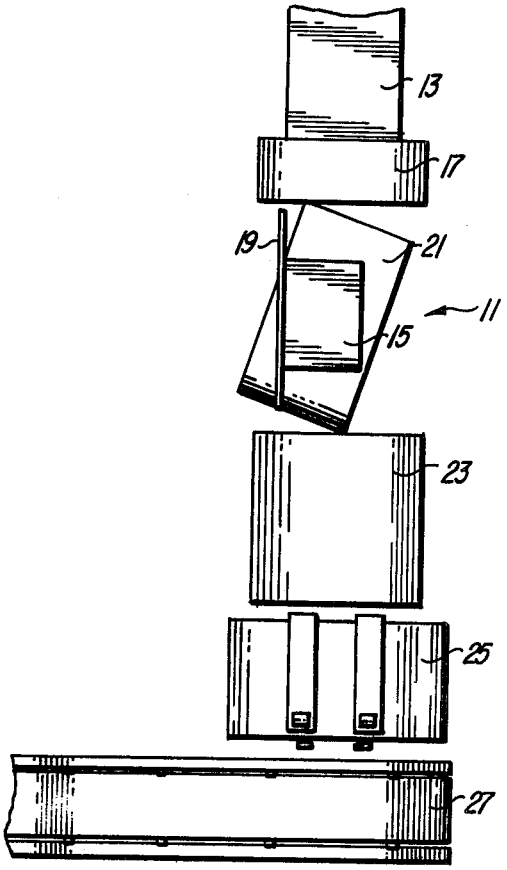
Fig. 1 (PRIOR ART)
Fig. 2 (PRIOR ART)
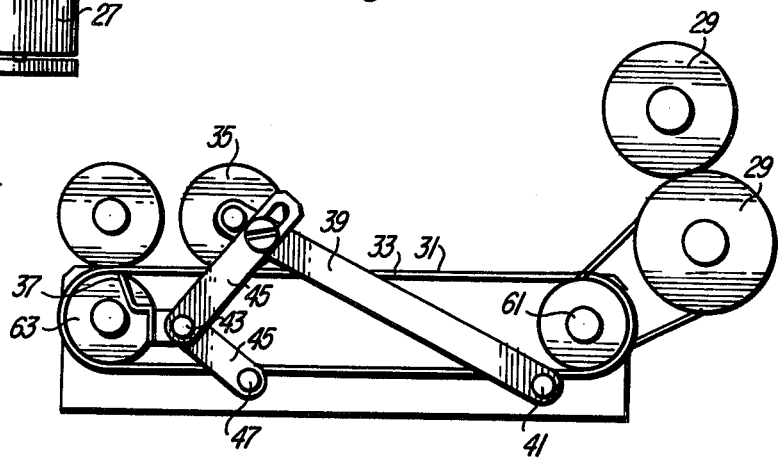
Fig. 3
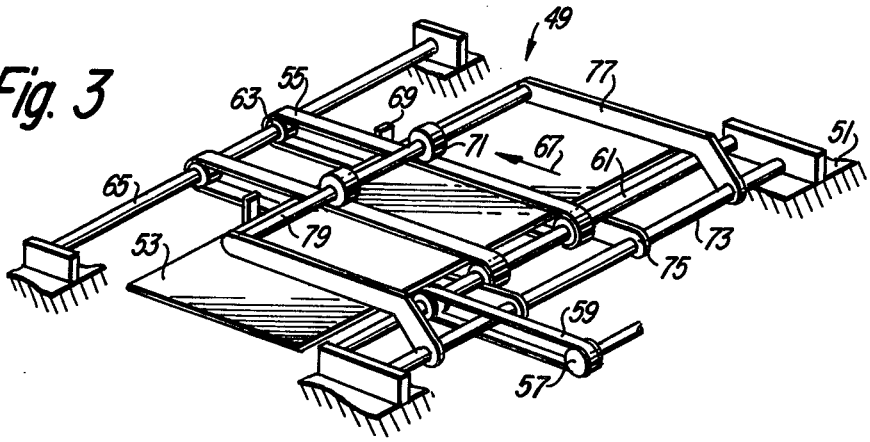

SHEET COLLECTOR

BACKGROUND OF THE INVENTION

This invention is related to application Ser. No. 642,276 filed Dec. 19, 1975, now U.S. Pat. No. 4,034,973 by Kenneth A. Hams for an automated in-line mailing system. The disclosure in the Hams application is hereby incorporated herein by reference.

Briefly, the above-described disclosure of Kenneth A., Hams, with reference to FIG. 1 hereof, is for a mailing system 11 which receives a sheet web 13, and cuts it into individual sheets 15 with a cutter 17. The individual sheets 15 are registered against a registering wall 19 by a skewed endless conveyor 21 and fed to a buckle-folding machine 23. The folded sheets are then deposited with a collector, or catcher 25. It is this catcher 25 with which this invention is concerned.

As is described in the Hams' disclosure, the cutter 17 cuts a sufficient number of individual sheets 15 to compose a letter and then it ceases to cut and feed further sheets. The endless conveyor 21 and the buckle folding machine 23 operate continuously, feeding the cut sheets to the catcher 25. The catcher 25 collects the sheets of a letter in a stack and counts the sheets as it receives them. Once the catcher 25 has received a full letter, it ejects, or dumps, the stack onto an insert track 27 to be combined with additional inserts and stuffed into an envelope. When the catcher 25 ejects a pile of sheets, it provides a signal to the cutter 17 to begin cutting and delivering sheets again. As mentioned above, the Hams' disclosure is incorporated herein by reference to provide the details of the FIG. 1 system. It should be noted that the Hams' disclosure further describes a "two-up" system wherein the cutter 17 cuts dual, side-by-side, individual sheets and there are two, opposite registration walls 19, a folding machine 23 which can handle side-by-side sheets, and side-by-side catchers 25. In this system, when the cutter 17 finishes cutting a letter on either side of the side-by-side sheets, the cutter 17 discontinues cutting further sheets. Thereafter, when either of the catchers 25 ejects a stack of sheets onto the insert track 27, the cutter 17 is signalled to start cutting sheets again.

The prior-art catcher 25 which has been previously used in the Kenneth A. Hams system is depicted generally in FIG. 2. In this prior-art system, sheets are fed from the folding machine 23 (FIG. 1), by means of feed rollers 29 (FIG. 2), onto a feed plate 31 (FIG. 2) which includes driven endless conveyor belts 33. In this system, idler drop rollers 35 are mounted above the feed plate 31 and stop fingers 37 are positioned below the feed plate 31. The drop rollers 35 are mounted on levers 39 which pivot at an axis 41 upstream of the drop rollers 35 and the stop fingers 37, and the stop fingers 37 are mounted at a central hinge 43 of scissor levers 45 downstream of the drop rollers 35. The scissors levers 45 pivot on the drop roller levers 39 and a main frame at 47.

In operation of the prior-art device, when the catcher is set to accumulate a pile of sheets, the drop roller 35 is in an up position and the scissors levers 45 cooperate to hold the stop fingers 37 up in the path of sheets conveyed by the endless conveyor belts 33 on the feed plate 31. Thus, the sheets conveyed by the feed rollers 29 will form a stack or pile on the feed plate 31. When the catcher is moved to transport the sheets, the drop rollers 35 are moved downwardly, thereby urging the collected sheet stack against the conveyor belts 33 to forcefully drive it forwardly, and the stop fingers 37 are moved downwardly through the linkage of the scissor levers 45.

A difficulty with the prior-art catcher is that there can be very little clearance between the upper tip of the stop fingers 37 and the lower surface of the drop rollers 35 (1/8th of an inch in one embodiment) thereby limiting the size of the sheet stack. Of course the dimensions of the various levers could be modified, however, such a modification would create space problems and require either greater force or more movement from an actuator. In addition, the linkage formed by the many levers 39 and 45 are quite cumbersome, and this is particularly true in the "two up" system described above where it is necessary to have two catchers side-by-side. With regard to the two-up system, it is difficult to obtain access to the various levers when another catcher is directly adjacent to the levers of a catcher being examined.

Thus, it is an object of this invention to provide a catcher which allows the accumulation of various size piles, including piles of larger sizes than those allowed by the prior art system described above, but which does not take up an undue amount of space and which allows easy access linkages when used in a "two up" system with two catchers side-by-side.

Other prior art structures which relate to this invention include those disclosed in U.S. Pats. 3,263,992 to Schrempp, 3,637,203 to French, 3,724,640 to Rapparlie, and 3,844,552 to Bleau et al. All of these patents describe devices which interrupt the flow of sheets by bringing stop members into the paths of the sheets and thereafter moving the stop members out of the paths of the sheets and bringing driving rollers into contact with these sheets to drive them further. Schrempp, French, and Bleau et al. control the flow of individual sheets in this manner without stacking them. In Rapparlie, however, the holding stop, or abutment, causes conveyed sheets to stack behind the abutment. This system actuates the abutment when the stack reaches a predetermined height and a pressure roller urges a conveyor against the stack to transport it beyond the abutment. In this patent, the roller and the abutment are on a nonadjustable straight lever and have a fulcrum positioned intermediate the abutment and the roller. Both the roller and the abutment are positioned on the same side of the path of the sheets. The lever is pivoted to alternately bring the abutment into a blocking position and the roller into a driving position.

A difficulty with the Rapparlie system is that the length of the lever and the position of the fulcrum are rather critical and allow very little adjustment without affecting the amount of angular rotation required of the lever. That is, the lever must be unduly sort in order that the roller and abutment are not separated by an unduly large distance. In short, this system lacks flexibility and does not allow the elements of the abutment and roller to be adjusted to accomodate various size sheet piles.

Therefore, it is another object of this invention to provide a stop-and-roller system for a sheet catcher which can be adjusted to accomodate various size sheet piles and which does not have stops and rollers separated by an unduly large distance on one side of a sheet path.

SUMMARY OF THE INVENTION

According to principles of this invention, rollers and stops are positioned on opposite sides of a feed plate of a sheet catcher. The rollers and stops are rigidly attached to a single idler-roller/stop shaft which is positioned adjacent to the sheet path, but below it. The idler-roller/stop shaft is rotated angularly to alternately move the stop and idler rollers into and out of the sheet path. The angular positions of the idler rollers and stops on the idler-roller/stop shaft are adjustable about the shaft to accomodate various size sheet stacks. Similarly, the amount of angular rotation of the idler-roller/stop shaft is also adjustable.

BRIEF DESCRIPTION OF DRAWINGS

The foregoing and other objects, features, and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a simplified plan, partially schematic, view of a prior-art mailing system in which the catcher of this invention is employed;

FIG. 2 is a simplified side view of a prior-art catcher;

FIG. 3 is a simplified isometric view of the sheet catcher of this invention;

DESCRIPTION OF A PREFERRED EMBODIMENT

Figure 4:
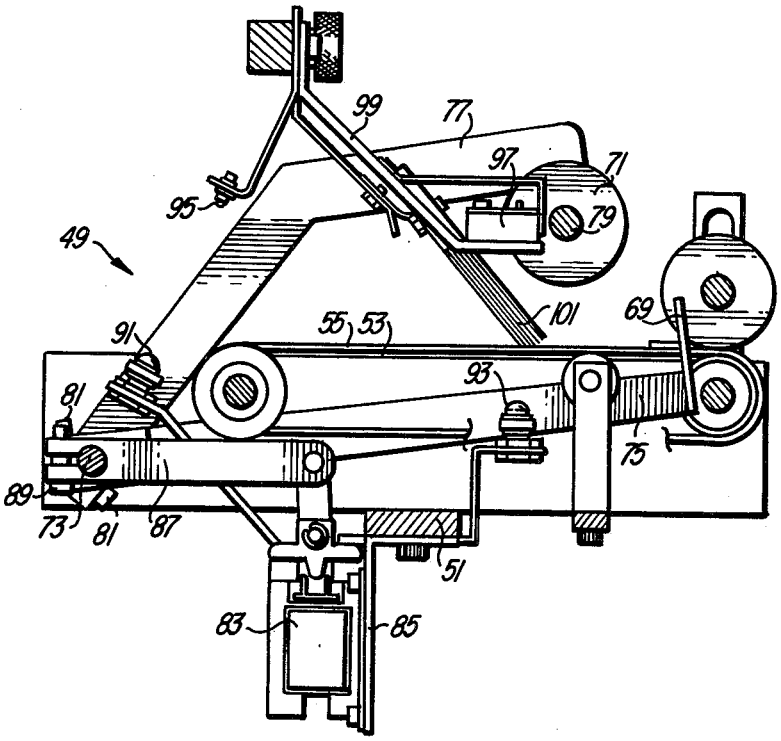
FIG. 4 is a sectional view taken on line 4—4 of FIG. 5, and showing additional elements shown in FIG. 5.
Figure 5:
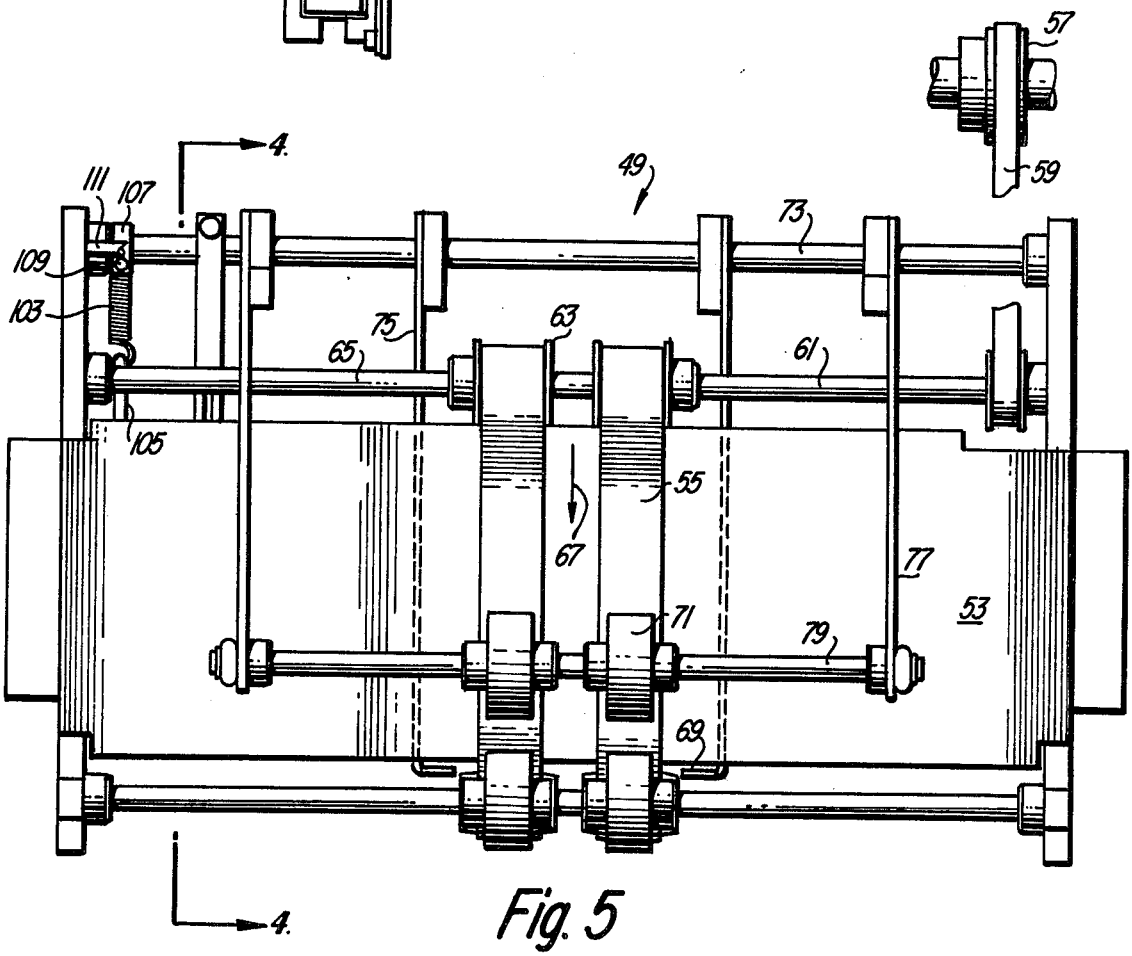
FIG. 5 is a plan view of the catcher of FIG. 3, but showing more details than of FIG. 3.

Describing in more detail the catcher of this invention, with reference to FIGS. 3–5, a catcher 49 is mounted on a frame 51. The catcher 49 includes a feed plate 53 which is rigidly mounted on the frame 51. Feed belts 55 rest on the surface of the feed plate 53 and are driven from a pulley 57 which is part of the preceding machine, such as the folding machine 23 of FIG. 1. The pulley 57 drives the feed belts 55 via a belt 59 and a drive shaft 61. The feed belts 55 ride on idler pulleys 63 which are mounted on a stationary shaft 65. The catcher 49 receives sheets on the feed plate 53 from the buckle-folding machine 23 (FIG. 1), for example, from rollers 29 as depicted in FIG. 2. The sheets are dropped onto the feed belts 55 of the feed plate 53 and are driven in a direction indicated by the arrow 67.

Stops 69 and idler rollers (or drop rollers) 71 control the flow of sheets along the feed plate 53. In this respect, when the stops 69 and the drop rollers 71 are in an up position, as is depicted in FIG. 4, the sheets positioned on the feed plate 53 and the feed belts 55 are held stationary against the stops 69 by friction between the feed belts 55 and the sheets. Thus, as sheets are placed on the feed belt 55, they are "stacked" against the stops 69. However, when the stops 69 and the drop rollers 71 are in a down position, the stops 69 release the stack of sheets and the drop rollers 71 urge the sheet stack against the feed belt 55 to eject the sheet stack from the catcher 49.

With regard to the linkage between the stops 69 and the drop rollers 71, they are both affixed to an idler-roller/stop shaft 73. The stops 69 are attached to the idler-roller/stop shaft 73 via stop bars 75 which extend between the stops 69 and the idler-roller/stop shaft 73 below the feed plate 53.

The drop rollers 71 are attached to the idler-roller/-stop shaft 73 by means of drop-roller levers 77. In this respect, the drop rollers 71 actually rotatably ride on an axle or shaft 79 which is attached at its ends to the drop roller levers 77. It will be understood that when the idler-roller/stop shaft 73 is oscillated back and forth, the drop rollers 71 and the stops 69 are alternately moved into and out of the path of sheets transported along the feed plate 53. The angular positions of the stop bars 75 and the drop-roller levers 77 on the idler-roller/stop shaft 73 can be adjusted by means of clamp screws 81 to adjust the machine to accommodate various size sheet stacks. The stop bars 75 are mounted along the idler-roller/stop shaft 73 inside the drop roller levers 77. In this respect, the drop roller levers 77 must be displaced from one another a distance which is greater than the widths of sheets being collected so that the sheets can pass between the drop roller levers 77. In another embodiment, where the idler-roller/stop shaft 73 is located above the path of sheets, the stop bars 75 must be sufficiently spread apart to allow sheets to pass between them.

With regard to rotation of the idler-roller/stop shaft 73, a solenoid 83 (FIG. 4), is mounted onto the frame 51 by a bracket 85. The armature of the solenoid 83 is attached to an operator lever 87. The operator lever 87 is clamped to the idler-roller/stop shaft 73 by a clamp screw 89 so that its position thereon can be adjusted. In this respect, by adjusting the position at which the operator lever 87 is attached to the idler-roller/stop shaft 73 the "throw" of the armature of the solenoid 83 can be adjusted. Thus, one can achieve even further adjustment for accommodating various size sheet stacks in the catcher.

With reference to FIG. 4, several refinements include detecting lights 91 and 93 and detecting photocells 95 and 97. The detecting light 91 is positioned below the path of sheets arriving at the catcher 49 opposite the detecting photocell 95. Every time a sheet passes over the detecting light 91, light to the detecting photocell 95 is interrupted so that associated circuitry attached to the photocell 95 can count the number of sheets arriving at the catcher 49. In this manner, it can be ascertained that the correct number of sheets have arrived at the catcher 49 before the catcher 49 is actuated to eject a sheet stack.

The detecting light 93 is positioned below the feed plate 53 opposite the detecting photocell 97 so that the detecting photocell 97 can detect when a sheet stack has been ejected from the catcher 49 and send a message to the cutter 17 (FIG. 1). It is noted that both of the detecting lights 91 and 93 and the detecting photocells 95 and 97 are affixed to portions of a stationary frame which it is not thought necessary to describe. In this respect, however, the detecting photocell 97 is mounted on a bracket 99 to which is also mounted brushes 101 which extend downwardly to rest on the top of a sheet stack located on the feed plate 53. The brushes serve to stabilize the sheets and prevent unwanted movements of the sheets.

Explaining further refinements, with reference to FIG. 5, a coil spring 103 is connected in tension between a portion 105 of the stationary frame and a spring hook clamp 107 that is clamped to the idler-roller/stop shaft 73. The spring 103 serves to bias the idler-roller/-stop shaft in an up position with the drop rollers 71 and the stops 69 up so as to collect sheets. A pin 109 mounted on the idler-roller/ stop shaft 73 strikes a pin 111 mounted on the stationary frame to hold the idler-roller/stop shaft in this normal position.

In operation, an operator determines the size of the letters he expects the catcher 49 to accumulate before ejecting the stack. Once he knows this, he adjusts the positions of the stop bars 75, the drop-roller levers 77, and the operator lever 87 on the idler-roller/stop shaft 73 to accommodate these stacks. An object of these adjustments is to allow the catcher 49 to accommodate the largest desired sheet stacks but yet to be fast and accurate in response to ejection signals.

Figure 6:
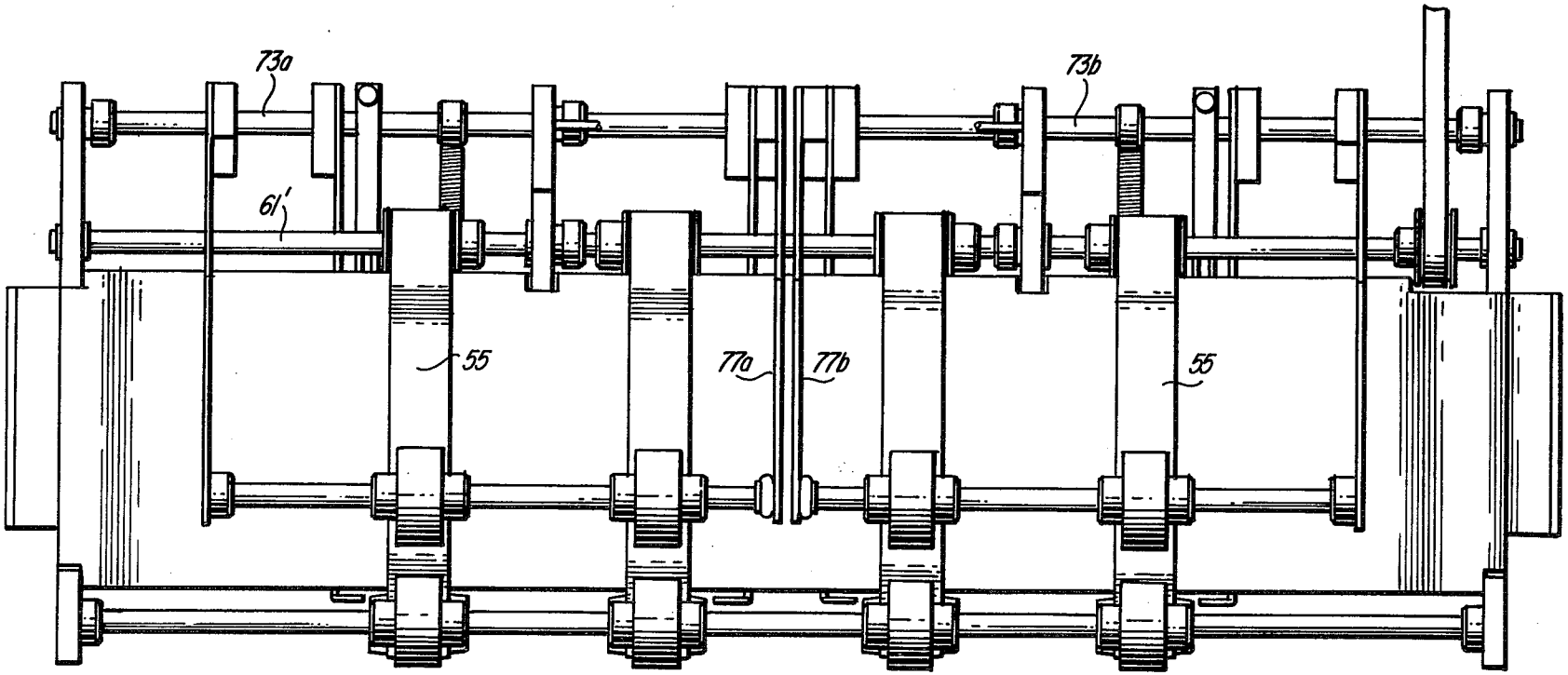
FIG. 6 is a plan view similar to FIG. 5, but depicting two catchers as they are used in a "two-up" mode of operation.

Once the operator has adjusted the various levers attached to the idler-roller/stop shaft 73, the machine is ready to be put into operation. Assuming the catcher 49 is used in a system as is depicted as element 23 in FIG. 1, sheets of letters that have been cut by the cutter 17 are fed to the catcher 49. In the normal position, the stops 69 and the drop-rollers 71 are in an up position as is depicted in FIG. 4 so that the stop 69 accumulates a stack of sheets against it. This stack of sheets is held against the stops 69 by the feed belt 55. Once the cutter 17 senses from the sheet web 13 that the end of a letter has been reached, the cutter 17 discontinues sending sheets to the catcher 49. By means of the detecting light 91 and the detecting photocell 95, the catcher 49 detects when all the sheets of the letter are stacked against the stops 69. At this point in time, circuitry (not shown) activates the solenoid 83 which pulls downwardly (as seen in FIG. 6) on the operator lever 87 to rotate the idler-roller/stop shaft 73 and thereby move the stops 69 and the drop-rollers 71 downwardly. The stack of sheets is thereby pressed between the drop-rollers 71 and the feed belts 55 and is freed to be thereby driven past the stops 69 and ejected from the catcher 49 by takeaway rollers.

It should be appreciated by those skilled in the art that the catcher assembly described herein is unusually flexible in operation and can be adjusted to accommodate various size sheet stacks.

With reference to the "two-up" embodiment of FIG. 6, it is noted that two adjacent drop-roller lever 77*a* and *b* can be easily placed side-by-side without requiring unduly large amounts of space therebetween. In this respect, since both of these levers are attached to independent idler-roller/stop shafts 73*a* and *b* at their rear ends, access to these elements is easily obtained. Otherwise, the two-up mode of FIG. 7 is substantially similar to the one-up mode which has already been described in connection with FIGS. 3, 4, and 5. It is noted that separate idler-roller/stop shafts 73*a* and *b* are required in the "two-up" mode with their associated stops and drop-roller elements. However, otherwise, feed belts 55 can be driven by a common drive shaft 61′.

It will be appreciated by those skilled in the art that the catcher assembly described therein is extremely flexible in operation and can be adjusted to fit various situations. In addition, the catcher assembly of this invention is extremely reliable and not unduly complicated.

In addition, the catcher arrangement herein described is particularly suitable for the "two-up" mode of operation wherein two catcher assemblies are positioned side-by-side.

The embodiments of the invention in which an exclusive property or privilege are claimed are defined as follows:

1. In a sheet collector of the type for serially, individually, receiving a plurality of sheets, retaining the sheets in a stack, and selectively ejecting the stack of sheets from the sheet collector, said sheet collector comprising:

a driven endless conveyor positioned on a first side of the path of said sheets, said driven endless conveyor having a surface for receiving said plurality of sheets, one on top of the other to form said stack;

at least one stop positioned downstream of said driven endless conveyor for selectively moving from said first side of the path of said sheets into and out of the path of the sheets driven by said endless conveyor to thereby block and unblock the movement of said sheets;

at least one idler-roller means positioned adjacent to said driven endless conveyor on a second side of the path of said sheets opposite to said first side for selectively moving toward and away from said driven endless conveyor to thereby contact said sheet stack and urge said sheet stack tightly against said driven endless conveyor and to release said sheet stack to allow said sheet stack to be loosely adjacent to said driven endless conveyor;

the improvement, wherein is further included:

an idler-roll/stop shaft positioned adjacent to the path of said sheets;

a shaft rotating means attached to said idler-roller/-stop shaft for selectively rotating said idler-roller/ stop shaft through a predetermined angle;

at least one stop bar rigidly attached to said idler-roller/stop shaft and said at least one stop and extending between said idler-roller/stop shaft and said at least one stop on said first side of the path of said sheets; and, at least one idler-roller lever rigidly attached at one end thereof to said idler-roller/stop shaft and at the other end thereof to said idler-roller means. said idler-roller lever extending between said idler-roller/ stop shaft and said idler-roller means on said second side of the path of said sheets.

2. In a sheet collector as in claim 1 wherein there are at least two stop bars and at least two idler-roller levers, and wherein said idler-roller means includes a shaft having a plurality of idler-rollers rotatably mounted thereon, side idler-roller means shaft being attached to said idler-roller levers at the outer ends of said idler-roller-means shaft, said two stop bars being positioned along said idler-roller/stop shaft inside said idler-roller levers.

3. In a sheet collector as in claim 2, wherein said idler-roller levers are spaced from one another a greater distance than the width of said sheets being processed by said catcher.

4. In a sheet collector as in claim 3 wherein is further included mounting means for said idler-roller levers and said stop bars for allowing angular adjustments of said idler-roller levers and said stop bars about said idler-roller/stop shaft.

5. In a sheet collector as in claim 4 wherein said shaft rotating means includes a means for adjusting the predetermined angle said shaft rotating means rotates said idler-roller/stop shaft.

6. In a sheet collector as in claim 3 wherein said shaft rotating means includes a means for adjusting the predetermined angle said shaft rotating means rotates said idler-roller/stop shaft.

7. In a sheet collector as in claim 1 wherein said shaft rotating means includes a means for adjusting the predetermined angle said shaft rotating means rotates said idler-roller/stop shaft.

8. In a sheet collector as in claim 7 wherein said shaft rotating means is a solenoid whose armature is attached to said idler-roller/stop shaft via a lever and the angular attachment of said lever to said idler-roller/stop shaft is adjustable.

9. In a sheet collector as in claim 1, wherein there are two independently operating stops and idler-roller means, side-by-side, each being driven by independent idler-roller/ stop shafts, and each including an independent shaft rotating means, at least one stop bar, and at least one idler-roller lever.

* * * * *

UNITED STATES PATENT AND TRADEMARK OFFICE

CERTIFICATE OF CORRECTION

PATENT NO. : 4,078,790

DATED : March 14, 1978

INVENTOR(S) : Lester H. Stocker

It is certified that error appears in the above-identified patent and that said Letters Patent are hereby corrected as shown below:

Column 2, line 57, correct the spelling of "short." Column 3, line 34, before "shown", insert --not--. Column 5, line 23, change "23" to --25--; line 50, change "lever" to --levers--. Column 6, line 46, change the period to a comma; line 55, change "side" to --said--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*